US010943572B2

(12) United States Patent
May

(10) Patent No.: US 10,943,572 B2
(45) **Date of Patent: *Mar. 9, 2021**

(54) INSTRUMENT CARRIER WITH ARTICULATING BACK BRACE

(71) Applicant: Randall May International, Inc., Irvine, CA (US)

(72) Inventor: Randall L. May, Irvine, CA (US)

(73) Assignee: Randall May International, Inc., Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/666,408

(22) Filed: Aug. 1, 2017

(65) Prior Publication Data

US 2017/0330537 A1 Nov. 16, 2017

Related U.S. Application Data

(63) Continuation of application No. 13/528,337, filed on Jun. 20, 2012, now Pat. No. 9,754,568.

(60) Provisional application No. 61/500,961, filed on Jun. 24, 2011.

(51) Int. Cl.
*G10G 5/00* (2006.01)

(52) U.S. Cl.
CPC ..... *G10G 5/005* (2013.01)

(58) Field of Classification Search
CPC ..... G10G 5/005
USPC ..... 224/265
See application file for complete search history.

(56) References Cited

U.S. PATENT DOCUMENTS 2,484,383 A * 10/1949 Lee ..... G10G 5/005 224/185
3,021,744 A * 2/1962 Kester ..... G10G 5/005 224/265
3,106,123 A * 10/1963 Johannsen ..... G10G 5/005 224/265
3,332,593 A * 7/1967 Fauser ..... F16M 13/04 224/185
3,405,587 A * 10/1968 Meazzi ..... G10D 13/026 84/421
4,158,980 A * 6/1979 Gauger ..... G10D 13/026 84/421
4,256,007 A * 3/1981 Streit ..... G10G 5/005 224/910
4,387,839 A * 6/1983 Dranchak ..... G10G 5/005 224/265

(Continued)

*Primary Examiner* — Peter N Helvey
(74) *Attorney, Agent, or Firm* — Crowell & Moring LLP

(57) ABSTRACT

A shoulder supported carrier structure supports percussion instruments on shoulder shoulders of a user is disclosed. A connecting member that spans between the shoulder supporting member behind the user or performer. The connecting member is joined to an arm that is connected to at a back member that allows the back member to pivot and translate relative to the two shoulder supporting members to allow the back member to align with a back of a user. The connecting member may be joined to the one arm with a frictional connection. The arm may be connected to the back member with a frictional connection. The back member at least partially contours to the shape of the back and may further include an inflatable cushioning bladder and is positioned between and under shoulder blades of the user to increase arm mobility.

19 Claims, 12 Drawing Sheets

(56) References Cited

U.S. PATENT DOCUMENTS 4,402,441 A * 9/1983 Jones ..... G10G 5/005 224/265
4,450,993 A * 5/1984 Ephraim ..... G10G 5/005 224/265
4,453,442 A * 6/1984 LaFlame ..... G10G 5/005 224/910
4,605,144 A * 8/1986 LaFlame ..... G10G 5/005 224/265
4,634,032 A * 1/1987 LaFlame ..... G10G 5/005 224/265
4,799,610 A * 1/1989 Hsieh ..... A45F 5/00 224/201
5,054,357 A * 10/1991 Pyle ..... G10G 5/00 84/421
5,337,646 A * 8/1994 Austin ..... G10D 13/00 248/122.1
D354,975 S * 1/1995 Penn ..... 224/910
5,400,683 A * 3/1995 LaFlame ..... G10G 5/005 224/265
5,573,158 A * 11/1996 Penn ..... G10G 5/00 224/197
5,949,008 A * 9/1999 Augsburger ..... G10D 13/026 84/421
6,028,257 A * 2/2000 May ..... G10D 13/00 248/443
6,096,955 A * 8/2000 Ter Heide ..... G10G 5/00 84/403
6,323,407 B1 * 11/2001 May ..... G10D 13/00 248/443
6,764,231 B1 * 7/2004 Shubert ..... F16M 13/04 396/419
6,863,202 B2 * 3/2005 Ammerman ..... A45C 13/30 150/110
6,881,886 B2 * 4/2005 May ..... G10D 13/00 248/443
7,071,401 B2 * 7/2006 May ..... G10D 13/00 84/421
7,166,790 B2 * 1/2007 May ..... G10G 5/005 248/443
7,276,653 B2 * 10/2007 Shimada ..... G10G 5/005 224/265
7,326,842 B2 * 2/2008 May ..... G10G 5/005 84/421
7,394,008 B2 * 7/2008 May ..... G10G 5/005 224/265
7,420,110 B2 * 9/2008 May ..... G10G 5/005 84/411 R
7,554,024 B2 * 6/2009 Miyajima ..... G10G 5/005 224/265
7,576,276 B2 * 8/2009 Hallerberg ..... G10G 5/005 224/265
7,671,261 B1 * 3/2010 Momose ..... G10G 5/005 84/421
7,673,776 B2 * 3/2010 May ..... G10D 13/00 224/265
7,810,684 B2 * 10/2010 May ..... G10G 5/005 224/265
8,420,919 B2 * 4/2013 Miyajima ..... G10G 5/005 84/421
2004/0194608 A1 * 10/2004 May ..... G10D 13/00 84/421
2005/0040193 A1 * 2/2005 May ..... G10D 13/00 224/201
2006/0186151 A1 * 8/2006 May ..... A45F 3/10 224/265
2008/0217368 A1 * 9/2008 Denton ..... A45F 5/00 224/159

* cited by examiner

INSTRUMENT CARRIER WITH ARTICULATING BACK BRACE

CROSS REFERENCE TO RELATED APPLICATION

This application is a continuation of U.S. application Ser. No. 13/528,337 filed on Jun. 20, 2012, which claims priority to provisional application 61/500,961 filed on Jun. 24, 2011, the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to a shoulder mounted percussion instrument carrier for one or an array of drums of various sizes. More particularly, the present invention relates to a carrier for one or more drums and replaces traditional "J" rods components. The elimination of the "J" rod components eliminates the interference with the user's legs and more particularly the user's thighs and provides a more natural stride of the user. Since the vertical or horizontal slots or saddle are not holes, that are commonly found with "J" rod carriers, the drum mounting structure can be repositioned or translated within the vertical or horizontal slots. The carrier allows the drum to be rigidly mounted in a variety of positions relative to the user. The mounting consists of a plurality of sliding connections that move independently from any adjustments from the carrier. The cantilevered weight of the drum(s) locks the drums into a vertical or horizontal slots or saddle. The structure also eliminates the necessity of a structurally rigid fixed abdomen plate and allows for use of a flexible and conforming abdomen plate.

Description of Related Art including information disclosed under 37 CFR 1.97 and 1.98:

The prior art discloses examples of carriers using "J"-rods on an instrument carrier to support one or an array of drums. A number of drum holding apparatus have been patented and used, but none provide the combination of features disclosed and claimed herein.

La Flame U.S. Pat. No. 5,400,683 discloses a carrier for percussion instruments having an abdominal plate connected at one end of a unitary frame partly encircling the wearer at the waist and having an upstanding rear portion pivotally connected to a back pressure plate. Shoulder bars are connected to the back-pressure plate and wrap about shoulders and support straps connect to the abdominal plate.

Hsieh U.S. Pat. No. 4,799,610 shows a carrier for percussion instruments having a "T" bar, a pair of shoulder bars, and a belly plate. The shoulder bars are bolted on a lateral plate of the "T" bar. The lateral plate has arc-like slots and spaced semi-circular holes permit bolts to slide in the slots. The fastening end of each shoulder bar has a hole and an arc-like slot from the upper portion to the lower portion permitting angular adjustment of the shoulder rightward or leftward for various applications.

La Flame U.S. Pat. No. 4,643,032 shows a carrier for various instruments such as marching bells, a marching xylophone or a marching marimba, which are supported on the apparatus by the use of suitably-constructed extension arms. The carrier frame is a U-shaped bent bar welded or otherwise attached to a belly plate and has extension arms, which project from the belly plate to engage and support the instrument.

La Flame GB patent 2,123,676 (based on U.S. Pat. No. 4,453,442) discloses a carrier for percussion instruments or the like which includes the combination of a belly plate with a carrier bracket for supporting an instrument at an outwardly-overhung position about a fulcrum area of contact with the front waistline area of the person, a rigid band with a generally bent contour to extend along a portion of the waistline area of the person to the back of the person, a back-plate riser arm supported by the ban to extend in a generally upward direction such that a portion of the arm will extend along the back thoracic region of the person, and means carried by the arm for imparting to the thoracic back region of the person a reactive force to the overhung weight of the instrument about the aforesaid means forming a fulcrum area of contact with the person.

Various patents from the applicant May have been issued covering carriers with "J" rods or similar attachment mechanisms for securing musical instruments, patents with this type of mechanism are found in U.S. Pat. Nos. 5,691,492, 6,028,257, 6,323,407, 6,329,583, 6,172,290, 6,403,869, 6,770,805, 6,881,886, 7,071,401, and published applications US2005/0040,193, US2006/0096,443, US2005/0103,183 and US2005/0183,565, but none of these disclose the carrier structure disclosed within this application.

Various prior inventions have been disclosed that attempt to provide mounting for one or a plurality of drums. Most of these products have the drum(s) fixed to the carrier or use "J" rods to secure the drum(s) to the carrier. These carriers have limitations that require an abdominal plate that is an integral part of the carrier. Because of the mechanical structure of these carriers they restrict or alter natural walking or rapid stride movement of the user. The proposed carrier provides improvements that eliminate the aforementioned limitations.

BRIEF SUMMARY OF THE INVENTION

It is an object of the shoulder mounted apparatus is to provide a carrier that allows a user to carry and play one or more drums while they transport the drum such as when they are walking, marching or rapidly moving. The mounting allows for the drum(s) to be maintained in a horizontal or rotated vertical orientation where the drumheads are oriented in a horizontal configuration allowing the drum to be played by striking the drumhead(s).

It is another object of the drum mounting apparatus, when it is configured with a single sliding (mono) post, to provide a simplified mounting apparatus that allows height of the horizontal playing surface of the drum to be raised and lowered by sliding the drum mounting apparatus on the single (mono) post. The mounting apparatus on the carrier has a vertical slot and the mounting apparatus on the drum has a horizontal pin or rod that slides into the vertical slot to secure the drum on the carrier. The drum is quickly removed from the carrier by lifting the pin or rod out of the slot.

It is another object of the drum mounting apparatus, when it is configured as with two or more posts to provide a stable box structure for the drum(s) to be supported on the carrier. The box structure refers to the two sets of slides or tracks that are mounted to the carrier and a corresponding two sets of slides are mounted on hardware having vertically or horizontally oriented slots or saddle. An array of drums is mounted to a tenor rail that engages onto the vertically or horizontally oriented slots or saddle to support the drums on the carrier. The overhung cantilevered weight of the drums secures the drum array in the vertically or horizontally oriented slots or saddle. The ability to integrate the slides onto the carrier allows the drums to be more rigidly secured to the carrier and significantly reduces flexing of the drum or drum array with the carrier to improve the stability of the playing surface when the user is moving or playing the drums. When the drums are brought closer to the user the overhung distance is decreased and the cantilevered load is decreased and reduces the strain on the back of the user. Since the tenor rail rests in the vertically or horizontally oriented slots or saddle the tenor rail can be slid horizontally in the carrier to justify the drums left or right of the center of the user. A user can place one or more marks on the tenor rail to identify specific balancing or positioning locations for the drum array when drums of different sizes and weights are placed in the drum array.

It is another object of the drum mounting apparatus to allow the drum or drum array to be easily installed and removed from the carrier to allow the drum or drum array to be placed in a floor mounted stand.

It is another object of the drum mounting apparatus to provide connection for an abdomen plate that can float or be removed from the carrier. This allows the abdomen plate to move with the user. Since the majority of the load from the drum(s) is from gravity the vertical load on the abdomen plate is essentially zero and the abdomen plate can be removed, secured on a pivoting mechanism with temporary securing means that does not penetrate the abdomen plate such as hook and loop fasteners.

It is another object of the carrier to provide a carrier where structure eliminates the necessity of a structurally rigid fixed abdomen plate and allows for use of a flexible and conforming abdomen plate.

It is another object of the carrier to include a connecting member that spans between the shoulder supporting member behind the user or performer. The connecting member is joined to an arm that is connected to at a back member that allows the back member to pivot and translate relative to the two shoulder supporting members to allow the back member to align with a back of a user. The connecting member may be joined to the one arm with a frictional connection. The arm may be connected to the back member with a frictional connection. The back member at least partially contours to the shape of the back and may further include an inflatable cushioning bladder and is positioned between and under or evades the shoulder blades of the user to increase arm mobility.

It is still another object of the carrier to integrate the two sets of dovetailed sliders is a parallel arrangement to allow the drums to be easily raised and lower on the carrier in a linear sliding arrangement.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
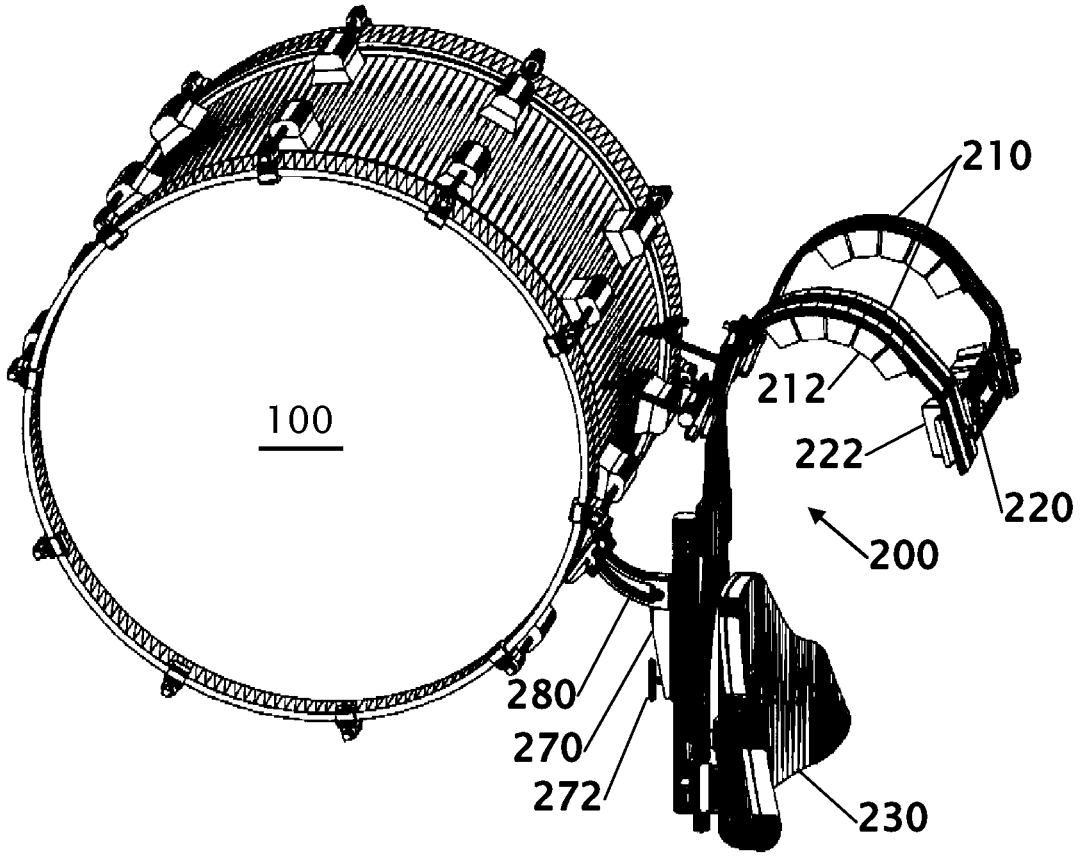
FIG. 1 is an isometric view of the carrier with a bass drum attached.

Referring to FIG. 1, there is shown an isometric view of the carrier with a bass drum attached. From this figure a bass drum 100 is shown attached to a carrier 200. The carrier is shown as a tubular constructed instrument carrier. In the preferred embodiment, the carrier is made in tubular construction, but the carrier can be T-bar, vest, a combination of the types listed or another configuration that is capable of retaining the mounting components to retain a bass drum. The carrier shown consists of shoulder straps 210. The shoulder straps have padding 212 placed in the area that makes contact with the shoulders of the user. The padding provides a cushioning of the shoulder straps to improve the comfort when a person is using the carrier with the bass drum. The shoulder straps can be adjustable or removable to better fit the size of the user. The carrier has a back member 220 attached to the free ends of the carrier. The back member may be adjustable, and or removably attached to the carrier. The back member may also have padding 222 attached to the side of the back member that makes contact with the user.

The shoulder straps attach to the front portion of the carrier. The front of the carrier extends down in front of the user and connects to a belly plate 230. The belly plate curves slightly to wrap around the frontal area of the user and provide a greater area contact. The side of the belly plate that makes contact with the user may also be padded to provide comfort to the user. In the area where the shoulder straps connect to the front of the carrier a connection device is located that allows attachment of a bass drum. This is best viewed in FIG. 2 that shows an exploded view of the carrier and the attachment components.

Figure 2:
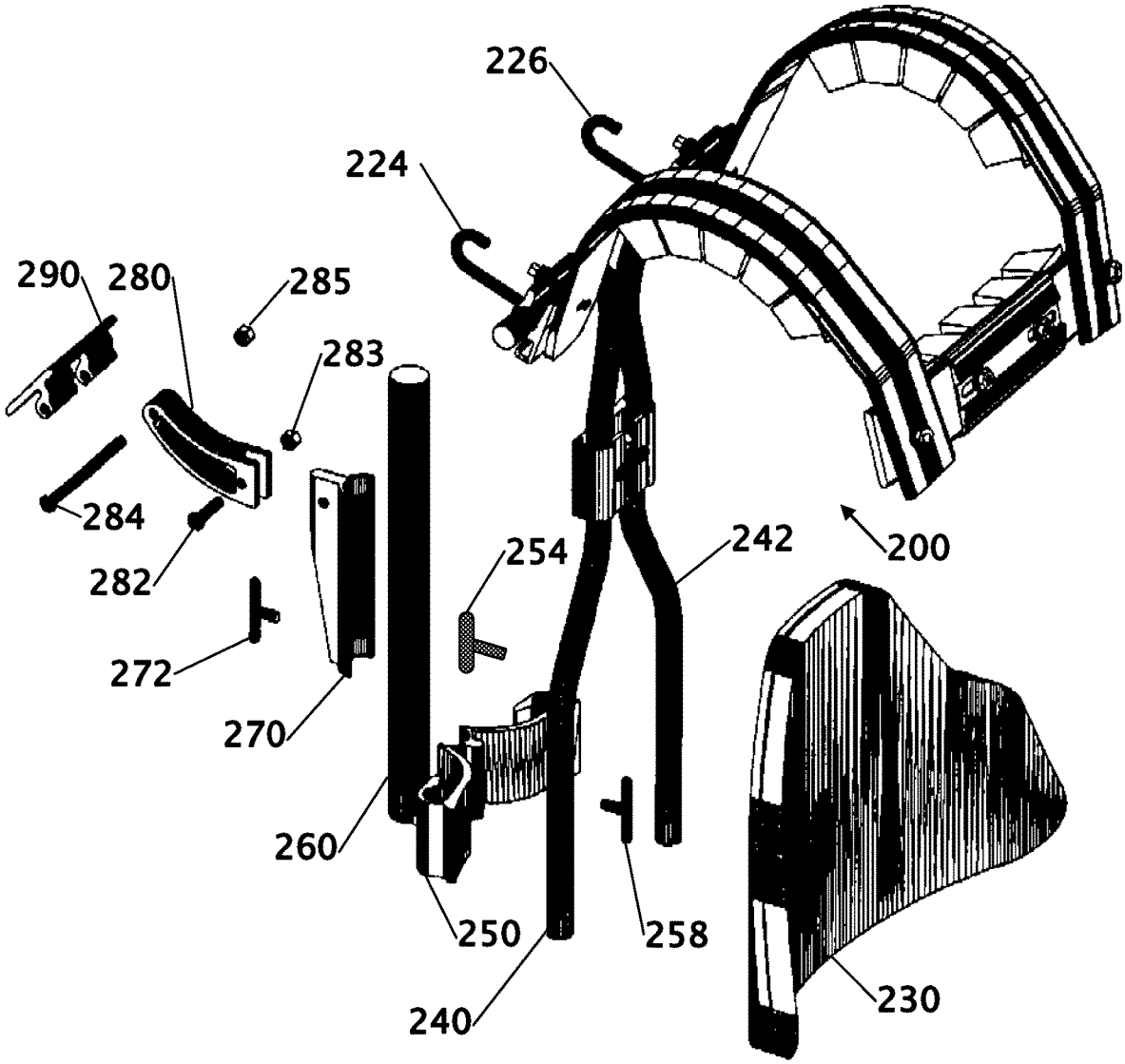
FIG. 2 is an exploded isometric diagram of the carrier with the components of the bass drum carrier shown.
Figure 4:
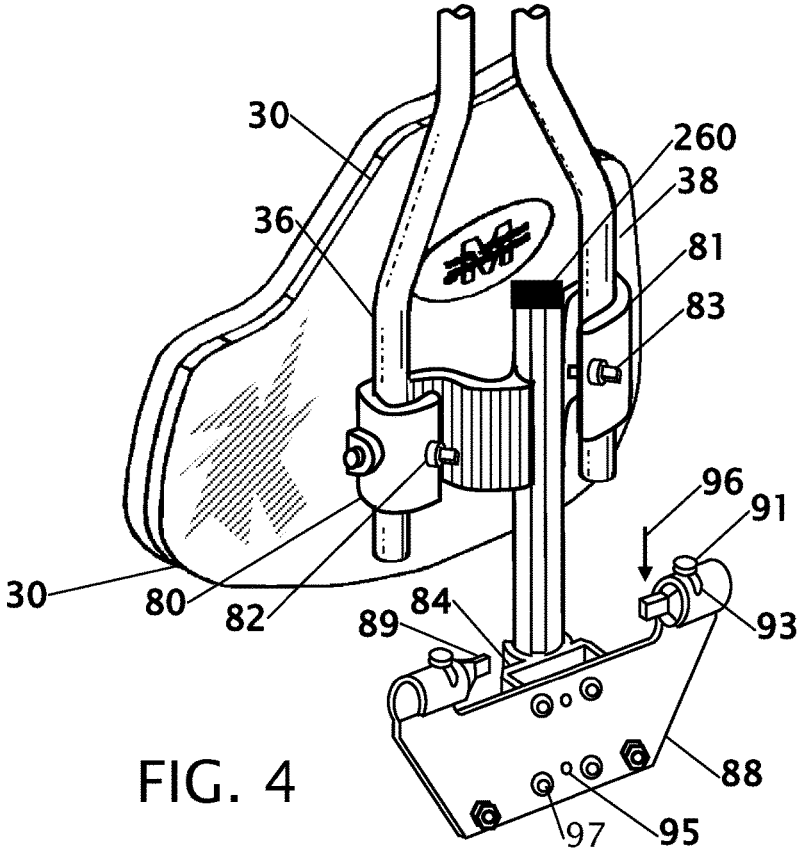
FIG. 4 is an alternate embodiment of the drum tracking system shown in FIG. 3.

In FIG. 2 the carrier is shown as a complete assembly with the belly plate 230 not connected to the carrier. The belly plate is shown not attached in this figure to show that the location of the belly plate can be adjusted up or down to accommodate users of different sizes. In the preferred embodiment, at least one attachment mechanism is a J-bolt or a similarly shaped device 224 and 226. The length of the J-bolts can be varied by replacing the J-bolts with longer or shorter J-bolts or by threading the J-bolts into the carrier to different depths. It is further contemplated that J-bolts of different lengths can be used to tip the drum to one side or the other to accommodate the preference of the user. The belly plate can also be replaced with belly plates of different sizes or shapes to accommodate the different sizes of users. In the preferred embodiment the belly plate is attached to the tubular constructed carrier using threaded hardware. The hardware attaches the belly plate through holes or slots locate in the tubes 240, 242 of the vest. If the attachment of the belly plate is with holes, the belly plate is located in finite increments where the holes are located on the tubes. If the attachment of the belly plate is with slots, the belly plate can be loosened on the tubes and slid into an infinite number location to accommodate each user. On the opposite side of the tubes of the carrier a lift base 250 forms a bridge between the tubes 240 and 242 of the carrier. The lift base has two semi-circular openings on each end where the tubes of the vest pass through. Refer to FIG. 4 to see the semi-circular openings where the tubes pass through the lift base. The lift base is attached to the tubes of the vest using a threaded fastener such as item 254 that clamps the lift base onto the tube(s) 240, 242. The lift base can slide on the tubes of the carrier to locate or position the lift base on the carrier.

A tube 260 slides into the center portion of the lift base. Two slots that run lengthwise down the sides of tube 260. These slots provide a guide and a retaining mechanism for the tube on the lift base. The tube can slide on the lift base, and be locked into position on the lift base with hardware such as item 258. A bass drum support slider 270 is also attached and slides in the slots that exist on the side of tube 260. The bass drum support slider can be moved on tube 260, and locked into a fixed position on tube 260 using hardware 272 or similar hardware. The bass drum support slider can be placed onto the tube 260 in either orientation based upon where the user wants to orient the remainder of the pieced of the bass drum support, and where they want to position the bass drum. A horn shaped member 280 attaches to the bass drum support slider with hardware such as item 282 and 283. This hardware allows the two members to pivot with each other and also be locked into position by tightening the nut 283 on the bolt 282.

The horn shaped member 280 is free to rotate on the bass drum support slider. Based upon the location of the bass drum support slider, and the location of the bass drum, the angular relationship between the horn shaped member and the bass drum support slider is established. At the opposite end of the horn shaped member a drum support member 290 is located that provides support to the bass drum. The connection between the horn shaped member and the drum support member is with hardware such as 284 and 285. This hardware allows the two members to pivot with each other and also be locked into position by tightening the nut 285 on the bolt 284.

On the flat portion of support member 290 a pad or cushion can be attached to reduce movement and damage to the bass drum 100. This pad cushions the drum if it moves up or down as the user is walking, marching or moving.

The primary function of components 250, 260, 270, 280 and 290 is to provide vertical and horizontal positioning of the bass drum. This positioning allows the bass drum to be moved up, down, closer and further away from the user. This allows the drum to be positioned in various locations for the comfort of the user. These components consist of a single contact point for the drum. The single contact point is one of three points that make contact with and or secure the drum to the carrier. Two remaining contact points are J-bolts 224 and 226.

The bass drum has the two eyebolts attached through the shell of the bass drum. The bass drum is attached to the J-bolts on the carrier by positioning the eye bolts over the J-bolts, and "hooking" the eyebolts onto the J-bolts. Once hooked together, the drum is rotated down until it comes in contact with the pad on the support member 290. The user can slide and position components 250, 260, 270, 280 and 290 to locate the drum in the playing position that the user prefers.

Figure 3:
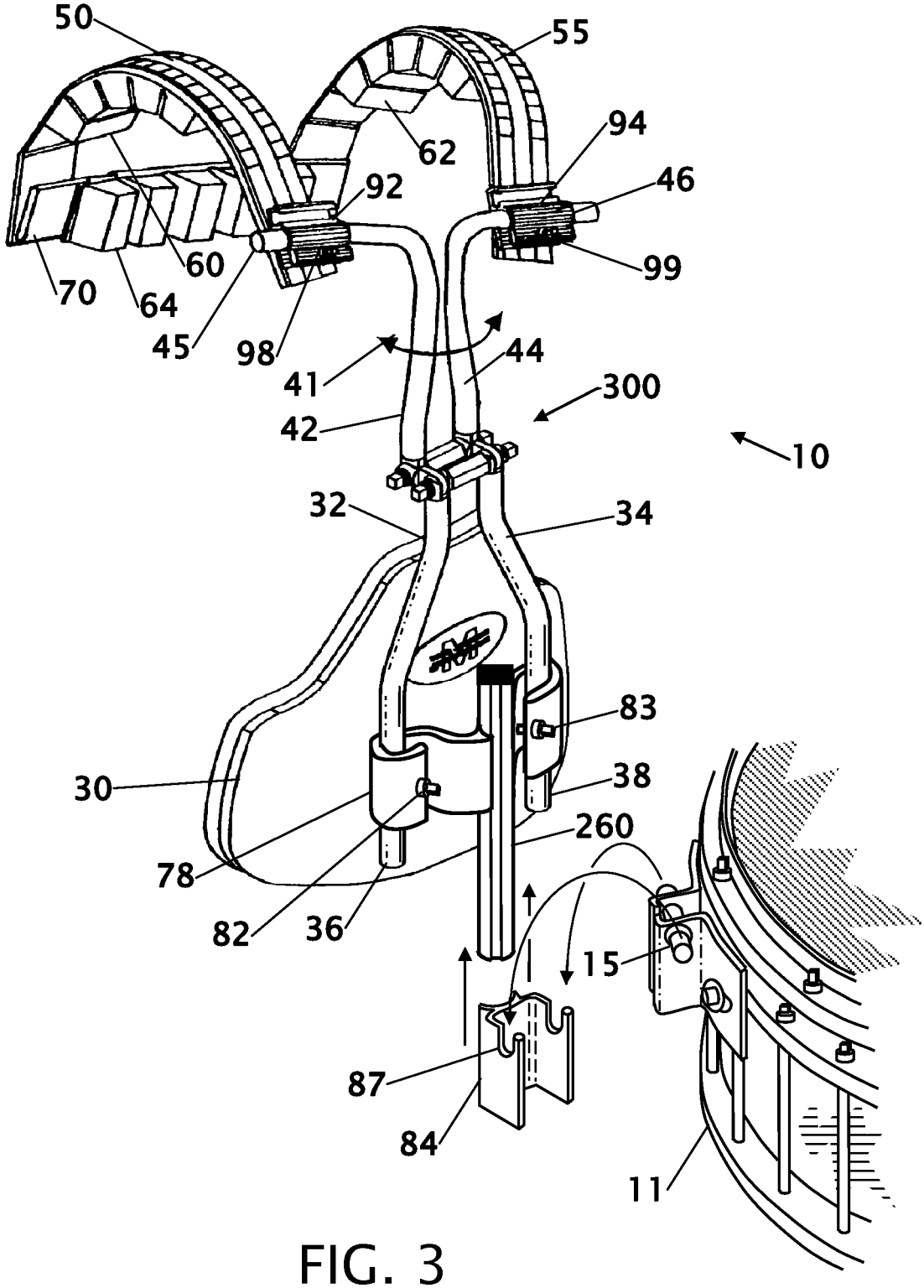
FIG. 3 shows a view of the drum tracking system for use with a single drum.

FIG. 3 shows a view of the drum tracking system for use with a single drum 11. This figure shows a Tubular type carrier 10 that is similar in construction to the carrier for percussion instruments shown and described in FIG. 1. The carrier 10 comprises an abdomen plate 30, with lower support rods 32 and 34. The figure also has upper body vertical support rods or tubes 42 and 44. The upper and lower body support rods or tubes are connected to each other with a retainer that keeps the tubes in a parallel relationship. The retainer is shown and described in FIGS. 11 and 12 in this application and in my May U.S. Pat. No. 7,673,776.

The lower rods or tubes 32 and 34 independently spread to parallel portions 36 and 38 where they attach to supporting abdomen plate 30. Upper rods or tubes 42 and 44 having out-turned portions 45 and 46 supporting rigid shoulder straps 50 and 55 and back bar 70. Back bar 70 may be removably secured to shoulder straps 50 and 55 or may be fixed as by welding or the like. Shoulder straps 50, 55, and back bar 70 have cushions 60, 62 and 64. The cushions are of a type used to pad the interior of football and other sports helmets and are shown in more detail in co-issued May U.S. Pat. No. 6,028,257. The cushions have a backing strip of polyvinyl plastic film. A thin sheet of polyvinyl film encloses blocks of closed pore plastic (e.g., polystyrene or polyurethane) foam and is sealed to the backing strip to enclose separate blocks which are separately compressible and provide more comfort to the wearer of the carrier when fully loaded.

The abdomen plate 30 is secured to the bridge supports 90 with a pivot 22 that extends through ears 24 on the abdomen plate 30. The placement of the pivot through the center of the bridge support 90 allows the abdomen plate to rotate a limited amount on the pivot(s) 22. The pivoting allows the abdomen plate to move with the user without significantly altering the position of the carrier on the user. The pivots can be tightened slightly to provide frictional or limited pivoting as well as loosened to allow for free pivoting. It is also contemplated that the abdomen plate 30 is removably secured on carrier.

Clamping receptacle(s) 92 and 94 consist of a semi-circular receptacle that tubes 45 and 46 fit through. Tightening hardware 98 and 99 clamps the tube or rod to secure them within the receptacle and prevent movement 41. The clamping receptacle(s) 82 and 83 are secured on abdomen plate 30 as bridge 78. The receptacles are shown mounted to the abdomen plate 30, and the tubes can be re-positioned within the receptacle, but the receptacles can be mounted to slots that allow the locations of the receptacles to be moved. The upper, out-turned ends 45 and 46 of supporting rods or tubes are supported in clamping receptacles 92 and 94 on shoulder straps 50 and 55. Clamps 92 and 94 hold rods or tubes 45 and 46 on the shoulder supports. Clamping mechanisms 92 and 94 consist of a semi-circular receptacle that tubes 45 and 46 fit through. Tightening hardware 98 and 99 clamps the tube or rod to secure them within the receptacle and prevent movement 41. A single tube or shaft 260 is used to connect with a single drum 11 through a sliding cradle 84.

The sliding cradle 84 connects to the single tube or shaft 260 with dovetail grooves. A second set of dovetail grooves exist on the bridge support member 78. The bridge support member 78 has male dovetail grooves that mate with the female dovetail groves in the tube or shaft 260. A similar set of male dovetail features 85 exist on the sliding cradle 84. These dovetail features are arranged to allow the sliding cradle to slide past the bridge support member 78. The sliding cradle 84 has a recessed cradle 87 for connection with the hinge pins 15 of a single drum 11. The hinge pin 15 is secured to the drum 11 with a rotation hinge plate. The rotation hinge plate 12 and its connection to the drum is shown and described in more detail in my May U.S. Pat. Nos. 5,691,492, 7,326,842 and published application 2009/0045235.

FIG. 4 is an alternate embodiment of the drum tracking system shown in FIG. 3. Only the lower portion of the carrier is shown with the drum connecting portion with the independently spread to parallel portions 36 and 38 where they attach to supporting abdomen plate 30. The connection of the abdomen plate is described with FIG. 3. Clamping receptacle(s) 80 and 81 consist of a semi-circular receptacle that tubes 36 and 38 fit through. Tightening hardware 82 and 83 clamps the tube or rod to secure them within the receptacle and prevent movement. A single tube or shaft 260 is used to connect with the single drum mounting hardware through a sliding cradle 84.

The sliding cradle 84 is secured to plate 88 with securing blots 97. Movement of the cradle 84 on the single tube or shaft 260 is prevented by locking set screws, or similar hardware, through access hole 95. The securing plate 88 has two drum rotators 89 that where a drum is slide 96 down the elongated tabs of the drum rotators 89. Gravity holds a drum in the elongated tabs. To rotate a drum thumbscrew 91 is loosened and the drum rotors are turned in the plate 88. The rotation of the drum is limited to the travel of the thumbscrew(s) 91 is slot 93. The structure that connects this hardware to a drum is described in May U.S. Pat. No. 5,691,492.

Figure 5:
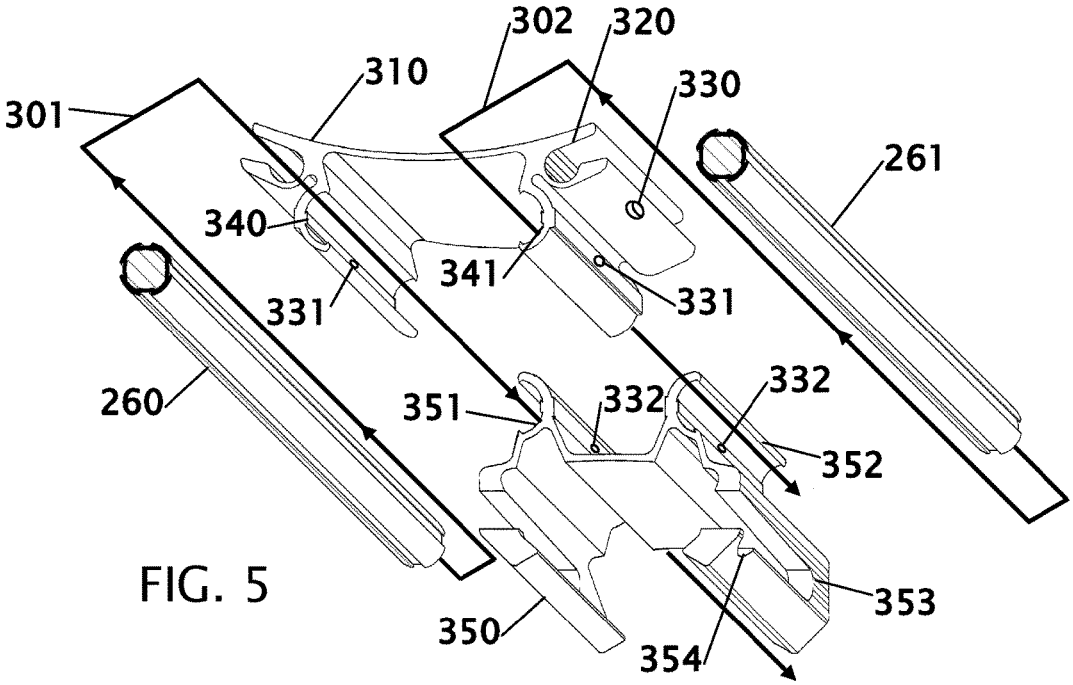
FIG. 5 shows the components of a dual track system that is mounted to an instrument carrier.

FIG. 5 shows the components of a dual track system that is mounted to an instrument carrier. For a better understanding of the components and how they relate, FIG. 6 should be viewed in combination with FIG. 5. In FIG. 5 the first bifurcated structure 310 is shown. This first bifurcated structure 310 has a radiused back that matches the contour of the abdomen plate that the structure in mounted on. On the front of first bifurcated structure 310 a pair of linear tracks 340 and 341 are integrated. The parallel tracks provide a first dual track structure. The tracks are located essentially parallel to the abdomen plate and at a location that is distal from the abdomen plate in a vertical orientation. It is contemplated that the abdomen plate 30 can float on the structure without being rigidly secured to first bifurcated structure 310. The first bifurcated structure 310 further includes mounting clamps 320 for securing tubular shafts for connection with the shoulder supporting portion of a carrier. The connection with the tubular portion of the shoulder supported portion of the carrier. A locking mechanism is threaded or fastened into the carrier at 330 to pinch or thread into the tube(s) 36 and or 38 (FIG. 4).

Figure 6:
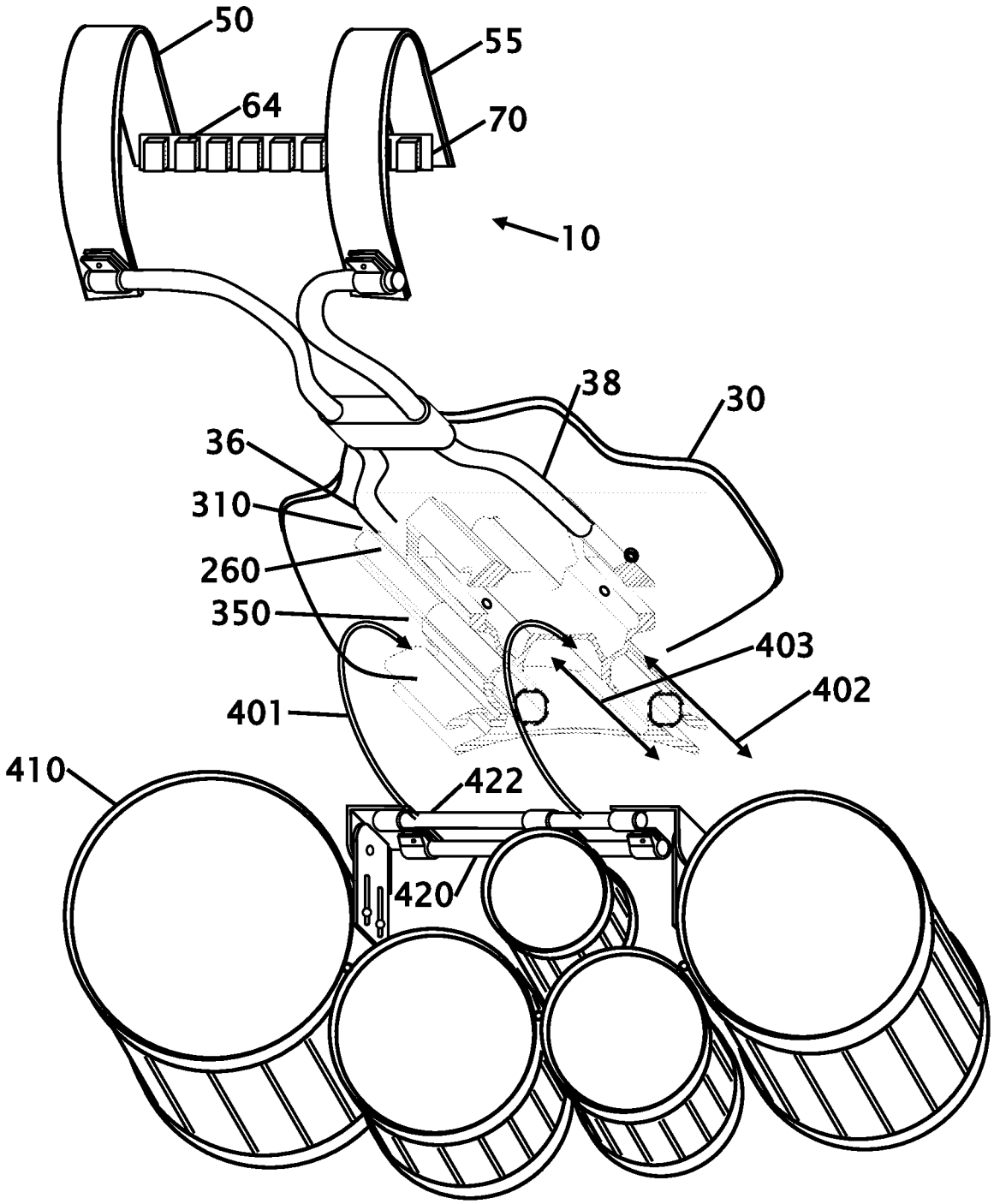
FIG. 6 shows an instrument carrier according to a preferred embodiment.

In FIG. 5 tubes 260 and 261 are slid 301 and 302 into the linear tracks 340 and 341 respectively. The linear tracks 340 and 341 have male dovetail recesses that engage in female dovetail recesses in tubes or rods 260 and 261. The tube and linear track is essentially the same configuration as shown and described in FIGS. 1-4. The tubes or shafts 260 are locked in location on the linear tracks of the first bifurcated structure 310 with a securing means such as a set screw or similar retaining or clamping mechanism 331. The second bifurcated structure 350 engages on the tubes 260 between the first bifurcated structure 310 to allow independent movement of the second bifurcated structure 350. The second bifurcated structure 350 has similar recess 351, 352 and dovetail engagement with the tubes or shafts 260 as in the first bifurcated structure 350. The second bifurcated structure 350 is secured to the tubes or rods 260 with securing means such as a set screw 332 or equivalent securing or clamping mechanism. In the front of the second bifurcated structure a pair of essentially vertically oriented slots exists for loading at least one drum or an array of drums 410 (FIG. 6). The vertical slots have a bottom radius or saddle 353 and a top radius 354 for locating the drum or drum array in the essentially vertically oriented slots.

In FIG. 6, the tubular carrier shown includes an abdomen plate 30 that is secured or can float on the structure without being rigidly secured to the halves of the first bifurcated structure 311 and 312. The support rods or tubes 34 and 36 of the carrier bend and extend into their respective halves of the first bifurcated structure 340 and 341 where they are positionable and lockable in position. The tubes 260 slide in their respective halves of the first bifurcated structure 340 and 341 to allow for positioning 402 of the drum array 410 and drum hardware independently from the positioning of the distance between the shoulder supports 50, 55 and the abdomen plate 30. In operation the drum array tube 420 from the drum array is lowered 401 into the essentially horizontal saddle 403 until the tube 420 from the drum array rests on the bottom radius of the half tube saddle portion 62. The cantilevered weight of the drum array will rotate the drum array until the upper tube 422 is nested into radius 354. The drum array tubes 420 and 422 can side horizontally along second bifurcated structure 350 where the drum array is justified left or right of the player.

Figure 7:
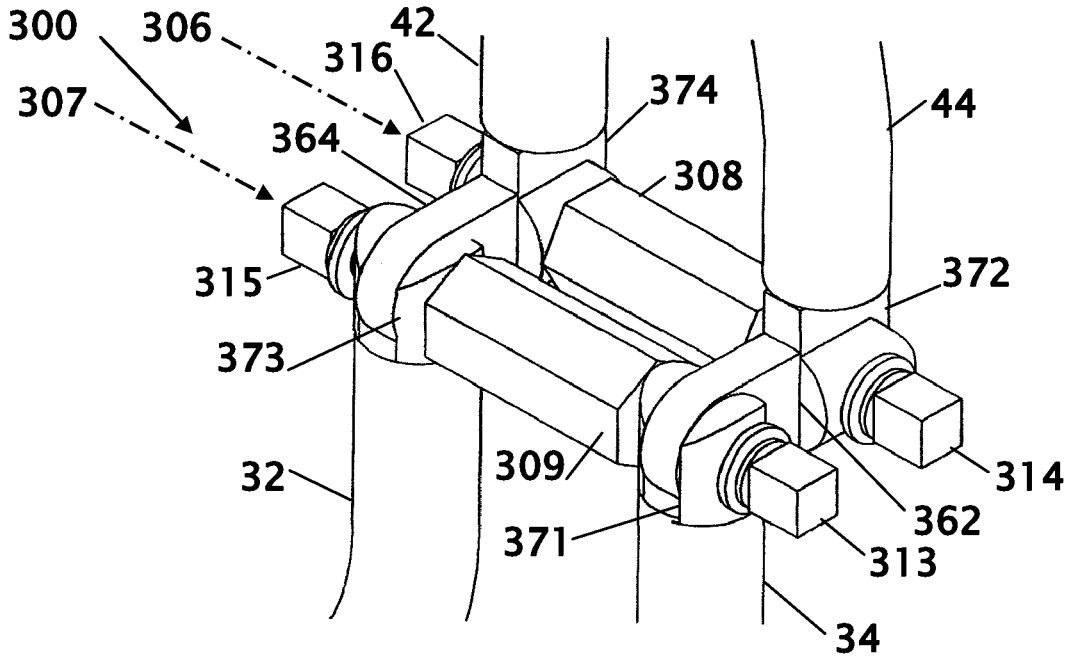
FIG. 7 is an isometric view of a compound adjustable hinge mechanism.
Figure 8:
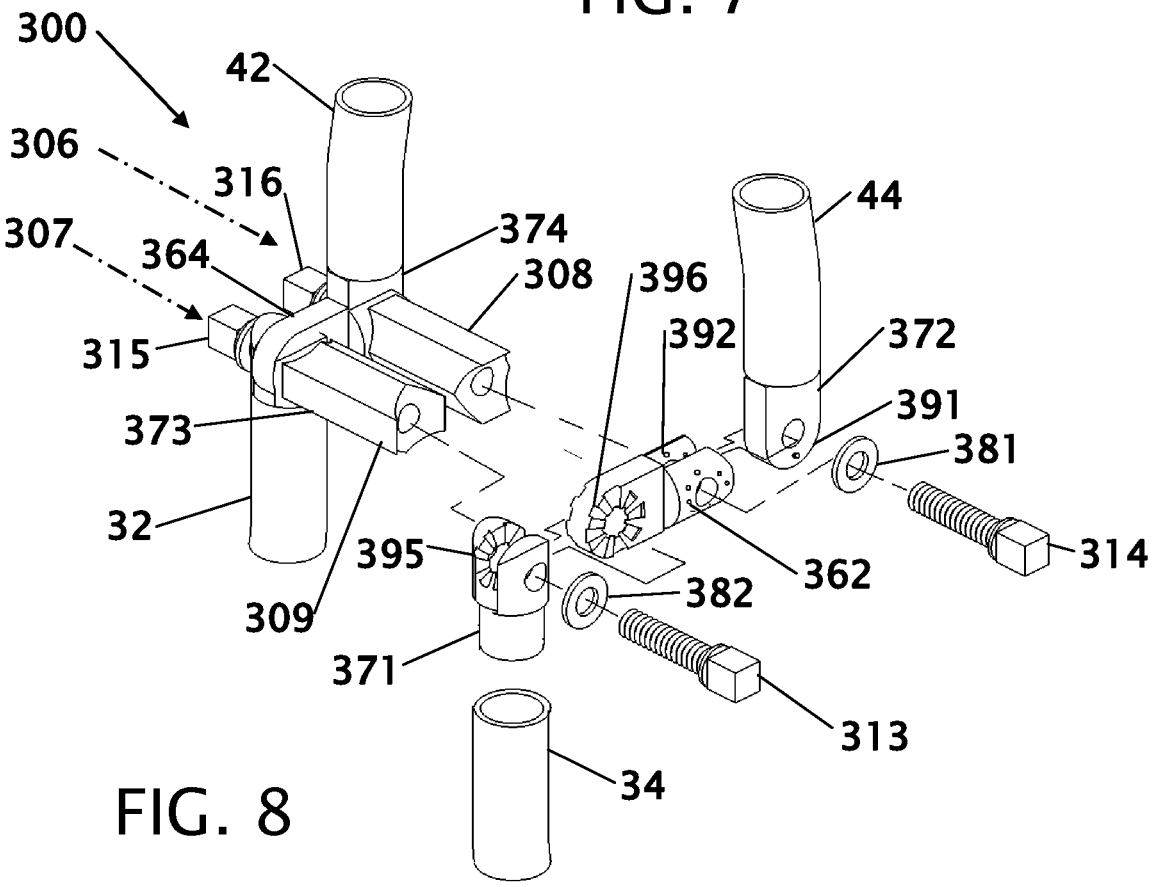
FIG. 8 is a detailed isometric exploded view of the components from FIG. 7.
Figure 12:
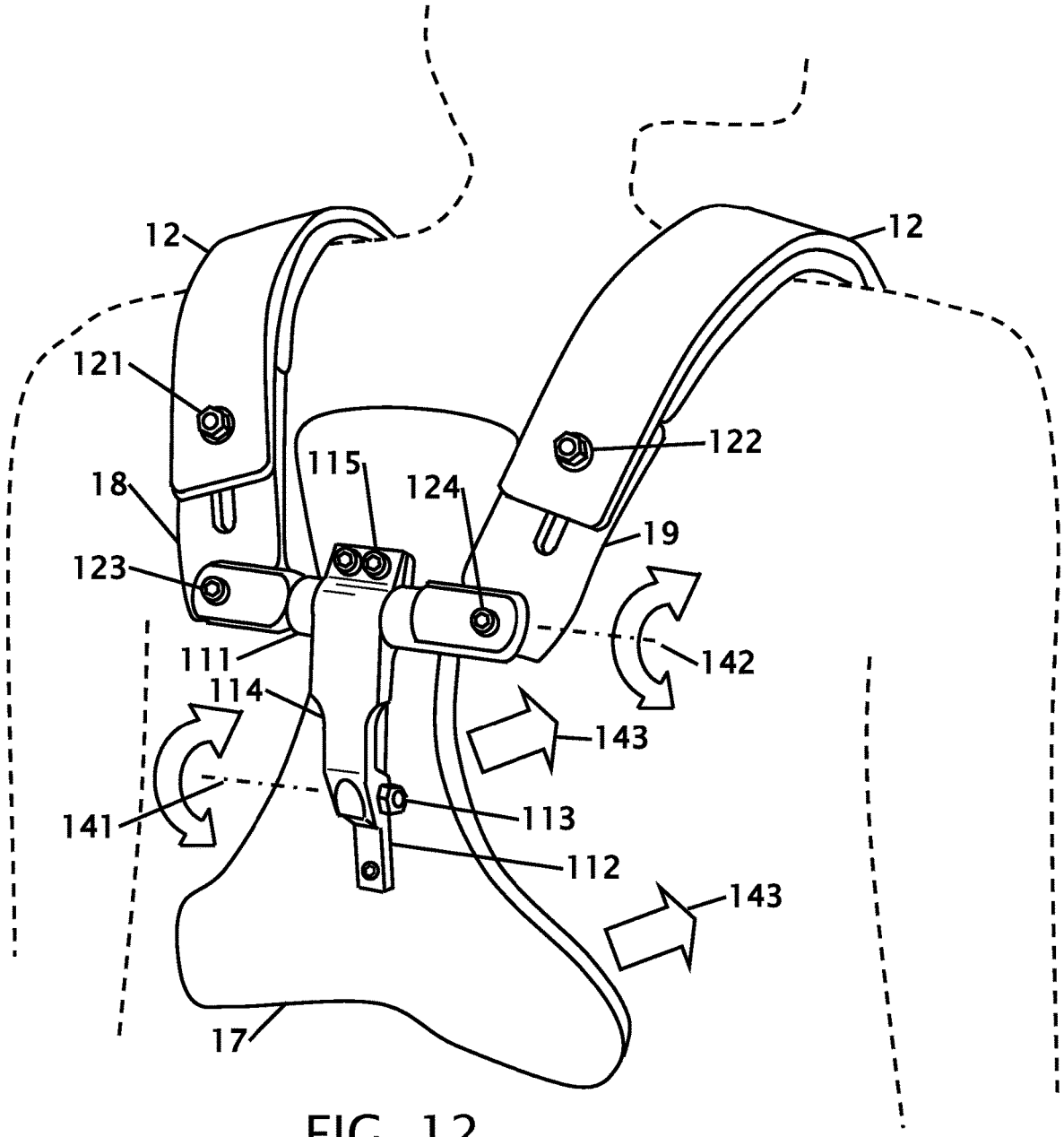
FIG. 12 shows a rear view of the conforming and articulating back member.

Referring to FIGS. 7 and 8, there is shown a compound hinge 300 from FIG. 3. This configuration of a compound hinge is described in the inventor prior U.S. Pat. No. 7,166,790. The compound hinges allow pivoting on two axes 306 and 307. FIG. 12 is a detailed view of the compound hinge mechanism. FIG. 8 is a detailed view of the compound hinge shaft from FIG. 7 where some of the parts are shown in exploded view to provide additional details regarding the construction of the compound hinge. The two axes are connected to a tubular construction carrier. Where tubes 42 and 44 are part of the upper portion of the carrier and 32 and 34 are connected to the lower portion of the carrier. Axis 306 and 307 can move rotate freely from each other. The components in each axis consist of central hex shaft 308 and 309 that bolts 313, 314, 315, and 316 thread into. A hex shaft is used so the shaft is easier to hold while the adjustment bolts are tightened or loosened. The tubes 32, 34, 42 and 44 have pivoting members 371 to 574 connected to the ends of the tubes. The pivoting mechanism also includes links 362 and 364. The bolts 313 to 316 go through connectors 371 to 374, then through links 362 and 364, and thread into central hex shafts 308 and 309. The bolts can be independently tightened or loosened to adjust that amount of movement in each hinge. Refer now to FIG. 8 that show details regarding the interface between members 362, 372 and members 362, 371. From FIG. 8, washers 381 and 382 are shown connected between bolts 314, 313 and members 371, 362. These washers are shown here as flat washers, but the washers may be any variety of washers including but not limited to wave washers, compression washers, and fiber washers or may be optionally excluded. The purpose of the washers is to provide a bearing surface for the bolts to rotate upon as they are being tightened. The interface surface between member 362 and members 371 and 372 can be a variety of types.

In the preferred embodiment, the interface between the mating bearing surfaces of member 362, 364 and members 371, 372, 373, 374 is smooth. In the case of smooth mating surfaces, one or all of bolts 313 to 316 can be loosened to allow the components of the compound hinge to move, rotate freely or provide infinite locking positions. While only two sets of compound hinge components are shown and described, more than two hinges can be utilized in the construction of the carrier. It is also contemplated that an entire carrier could be constructed with hinge components where each hinge can be individually adjusted. If the interface between the member 362 and members 371 and 372 are smooth an infinite number of angular settings can be made and locked with bolts 313 and 314 to fix the angular relationship between the compound hinge components. Using smooth interfacing surfaces, bolts 313 to 316 can be partially tightened to allow various degrees of frictional movement between the compound hinge components, or locked into position or a combination thereof.

An alternate embodiment of the mating surfaces of the compound hinge is shown with a ball 391 and hole 392 configurations. In this embodiment, one or more balls or raised areas exist of one member. The ball or raised member is shown here as 391 on item 372, the hole or recess is shown here as 392 on item 362. In this embodiment, the members can be locked in 45-degree increments, or in the positions where the ball or raised area falls into the hole or depressed area. In another embodiment of the mating surfaces of the compound hinge is shown as radial lands and groves as identified as items 395 and 396. In this embodiment four, eight or more radial lands and groves exist on the mating members 372 and 362. In this embodiment, the members can be locked in 45-degree increments, but can be manufactured with any number of increments, or positions where a land in one component falls into a groove in the mating component. In the previous described embodiment the angle between the members is adjusted by loosening bolts 313 to 316 rotating the members into position and tightening bolts 313 to 316. Three different types of mating surfaces have been described, but other types can be utilized that allow the hinge components to move and or lock in various positions.

Figure 9:
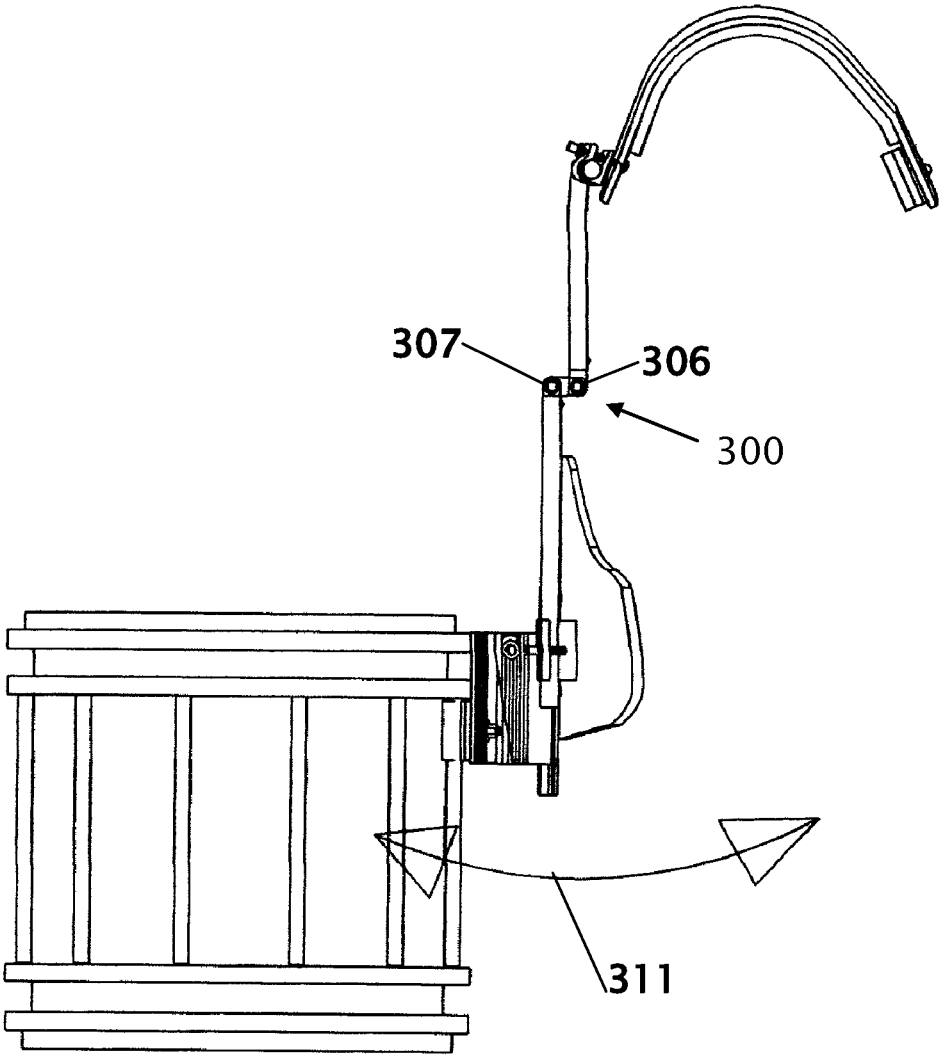
FIG. 9 is an isometric view of another embodiment of a compound hinge mechanism.

FIG. 9 show an orientation where one axis 306 of the compound hinge 300 is locked and the second axis 307 can rotate. This figure shows motion 311 where the drum can swing with only one axis fixed 306 or 307. A frictional member such as a bearing, felt, washer, wave washer or other spacer material may be used between the joined hinge members to provide some resistance to rotation or pivoting.

Figure 10:
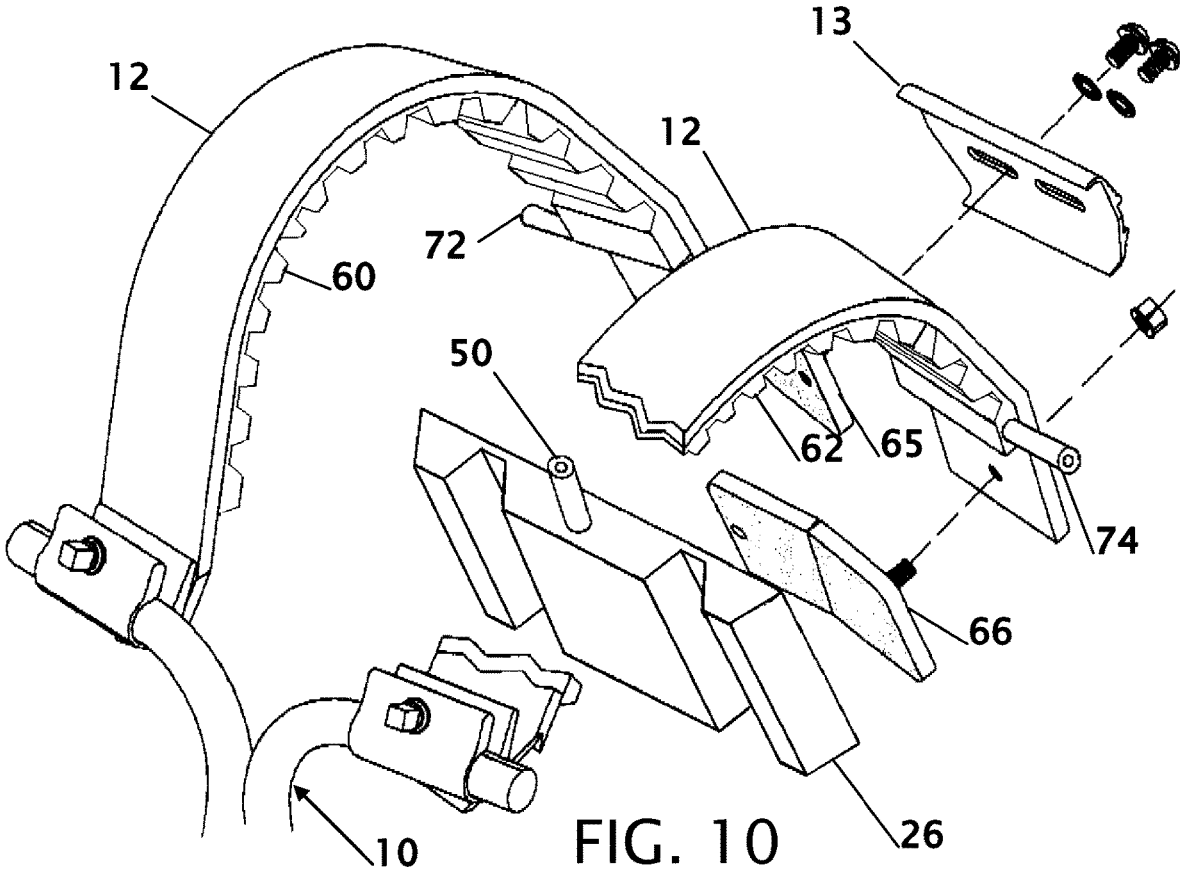
FIG. 10 is a detailed view of an inflatable back member in one possible embodiment.

Refer now to FIG. 10 that shows a detailed view embodiment of the pads were the pads are corrugated in configuration and connected to the shoulder straps and back members. A portion of a tubular carrier 10 is shown in this figure. This corrugated configuration allows the same adjusted to fit the contour of a person but also reduces the contact area with the user. In this figure, a single valve to 72 fills the pad on one shoulder cushion 60 and a second single to 74 fills the cushions 62 on the other shoulder straps 12. The back pad 64 can be filled through a single valve 76. In this figure, the back member is attached to the shoulder straps using three separate pieces. Connecting members 65 and 66 are each connected to the shoulder straps while adjoining component 13 spans the connecting members 65 and 66. This three-piece configuration of the back member, allows the components of the back member to telescope or slide inside each other to allow for adjusted for the back member. While this telescoping configuration is shown with three pieces it can also be accomplished with as few as one piece with an elongated slot, two or more than three pieces that will accomplish the same result.

Figure 11:
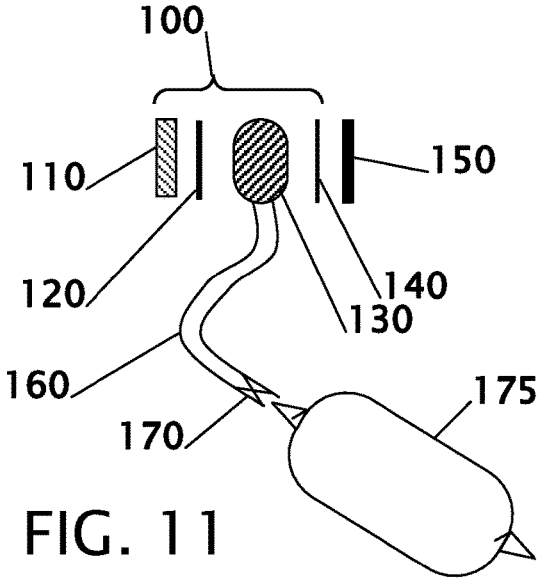
FIG. 11 is a cross-section of one contemplated embodiment of a cushion.

In FIG. 11 show a cross-sectional view of the pad and expandable bladder 100 portion of the cushion on a member such as a back or shoulder 150. The expandable bladder is made from a flexible minimally stretching material such as Mylar, vinyl, PVC, Polyester, polycarbonate, polyurethane, but the bladder may be made from an expanding material such as rubber or latex. The expandable bladder(s) are shown and described in more detail in my May U.S. Pat. No. 7,810,684.

The optional front pad 110 is a semi-firm pad made of felt, rubber, Latex, Neoprene or other similar material that allows improved comfort in addition to a surface that breaths to reduce perspiration of the user. A covering such as Mylar 120 or similar material can be located between the pad 110 and an expandable bladder 130. The Mylar sheet provides a rigid surface for the bladder to push against. This rigid surface helps to keep the bladder flatter as the bladder is filled with air to reduce ballooning of the pad. The pad 110 is can be attached directly to an expandable bladder 130 that can be filled or emptied of air. Varying amounts of air can be placed into or removed from the expandable cushion to provide varying amounts of expansion. The bladder is attached to the shoulder support/shoulder strap 12 and or the back member/back support 13 that provides additional support to the bladder cushion. The attachment of the pad to the Mylar and the Mylar to the bladder can be made using a variety of methods including, adhesive, ultrasonic, two part adhesives, Velcro or thermal bonding. The pad 130 is attached to the shoulder strap or back member using various methods including adhesive, ultrasonic, two part adhesives, Velcro or thermal bonding. In the preferred embodiment an adhesive 140 or Velcro pad(s) are used to removably attach the expandable pad to member 150.

The expandable bladder 130 is connected to a hose 160 that is used to fill and empty the expandable bladder. The hose allows for a flexible connection from the bladder(s) to the filling location. Multiple pads or bladders can be connected together with similar hoses to allow the multiple bladders to be adjusted at the same time. A spring-loaded valve 170 is located at the end of the tube to maintain pressure inside the bladder or cushion. A manual pump 175 can be inserted into the spring-valve 170 and when squeezed, air is removed or vacuumed from the hose assembly, making the bladder collapse, and pull against the shoulder strap.

In the preferred embodiment, the bladder is expanded with air, but the bladder can be filled or expanded with any gas or medium that can expand the bladder such as CO2, Argon, Helium, water, or even a powder.

FIG. 12 shows a rear view of the conforming and articulating back member. The view of the articulating back member is shown mounted on a user where the shoulder supports or straps 12 extend over the shoulders of a user. The end of the shoulder straps 12 are connected with hardware 121 and 122 to extenders 18 and 19. The extender 18 and 19 allow for adjustment of the length of the shoulder supports or straps down the back of a user. Slots or multiple holes are used to extend the length of the shoulder members or straps 12. The extenders 18 and 19 are connected with hardware 123 and 124 to a horizontal connecting member 111 that both connects the two shoulder members and creates a pivoting axis 142 that allows the back member 17 to swing into the performer on arm 114. Hardware 123 and 124 can be loosened and repositioned or slid in holes or slots in the horizontal connecting member 111 to change the width and or angle of the shoulder members 12.

Hardware 115 secures the arm 114 around the horizontal connecting member. This hardware 115 can be adjustable to change the frictional resistance for pivotal movement 142. Arm 114 pivots 142 on one end with the horizontal connecting member 111 and on the other end 141 through connector 113 that is secured to a bracket 112 that is connected to the back member 17. The arrangement of the pivoting axes 142 and 113 allows the back member to move 143 towards and away from the back of the performer to provide an even pressure on the back of the performer to more evenly distribute loads that push into the back of the performer. The shape of the back member 17 is contoured to bridge between the shoulder blades thereby reducing restriction of arm movement.

Figure 13:
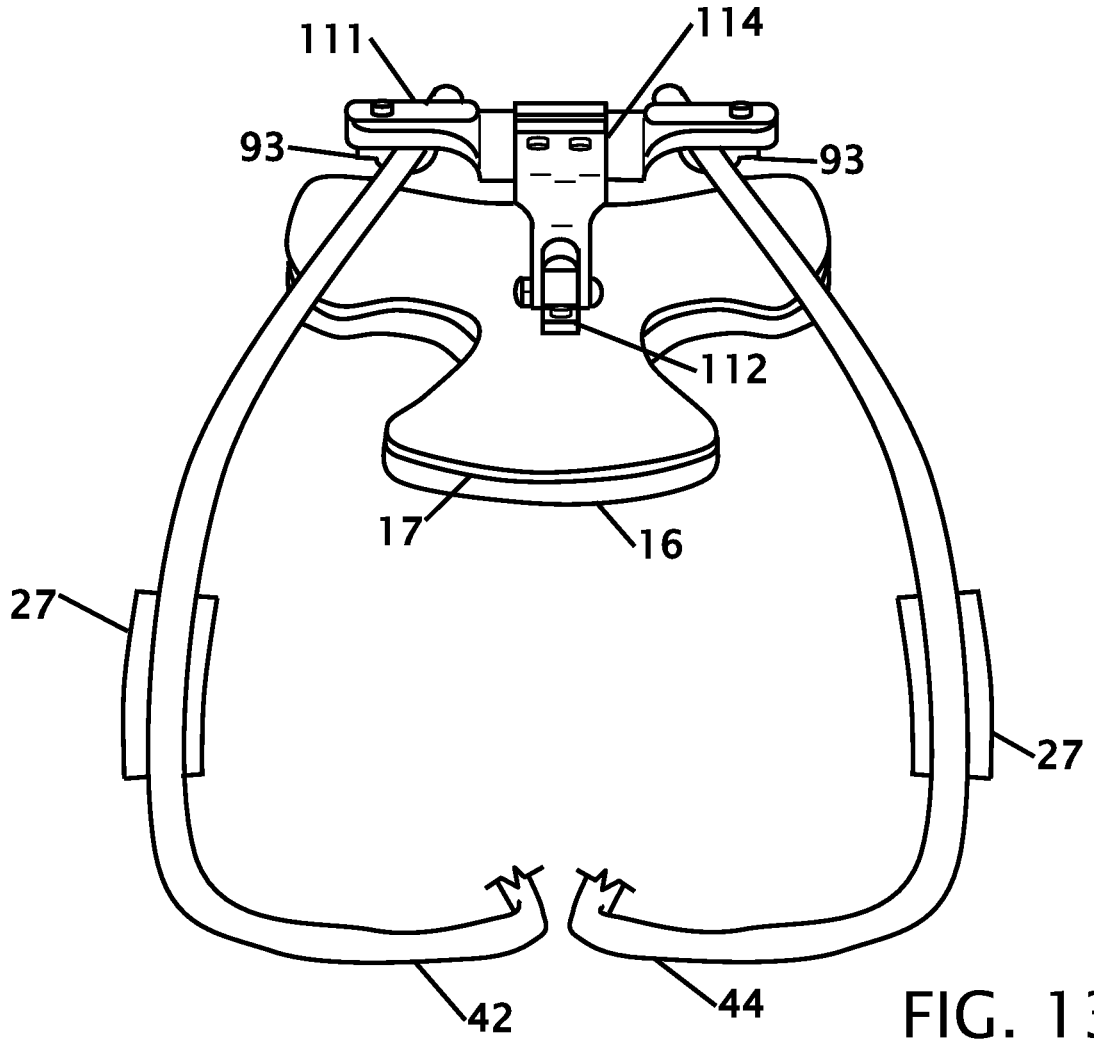
FIG. 13 shows a top view of the conforming and articulating back member.

FIG. 13 shows a top view looking down from the top of the instrument carrier onto the conforming and articulating back member 17. In this figure, a portion of the tubes of the upper rods or tubes 42 and 44 are shown as they extend over the shoulder where pads 27 cushion the apex of the shoulders. It is further contemplated that a pivotable connection can exist near the apex of the shoulder pads 27. The head of the performer passes through the open area between the shoulder pads 27. The shoulder supports 12 connect with hardware tube clamps 93 to the though connector 111. Because the upper rods are tubes 42 and 44, the position of the back member 17 can be adjusted by changing the position of the tube clamps 93 on the tubes. Pivot arm 114 connects to mounting bracket 112 and into the back member 17. Pad 16 is shown attached to the back member 17. The pad provides a cushion to more evenly distribute to load of the back member onto the user's back. In one embodiment it is contemplated that the pad can be a gel or air filled bladder as previously described in FIGS. 10 and 11. It is also contemplated that the tubes can be broken and hinged at some point near or a distance from the apex of the shoulders to allow the distance between the front of the carrier and the back member 17 to be adjusted.

Figure 14:
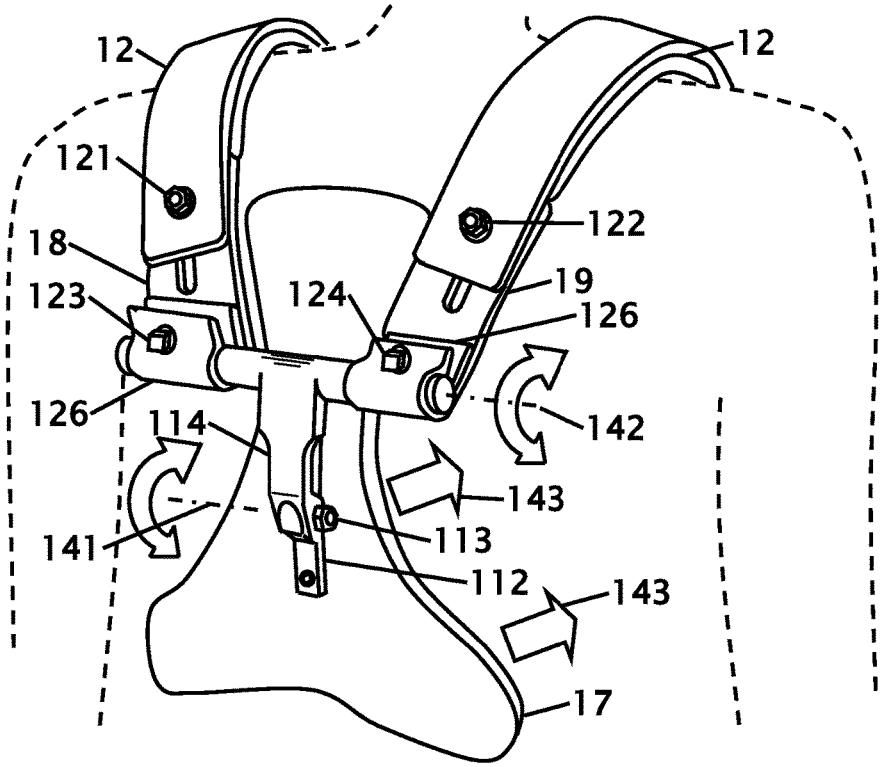
FIG. 14 shows a rear view of the conforming and articulating back member as a contemplated variation of the embodiment shown in FIG. 12.

FIG. 14 shows a rear view of the conforming and articulating back member as a contemplated variation of the embodiment shown in FIG. 12. In this contemplated variation the tube clamps 126 are used to connect the securing arm 114 between the extenders 18 and 19.

Figure 15:
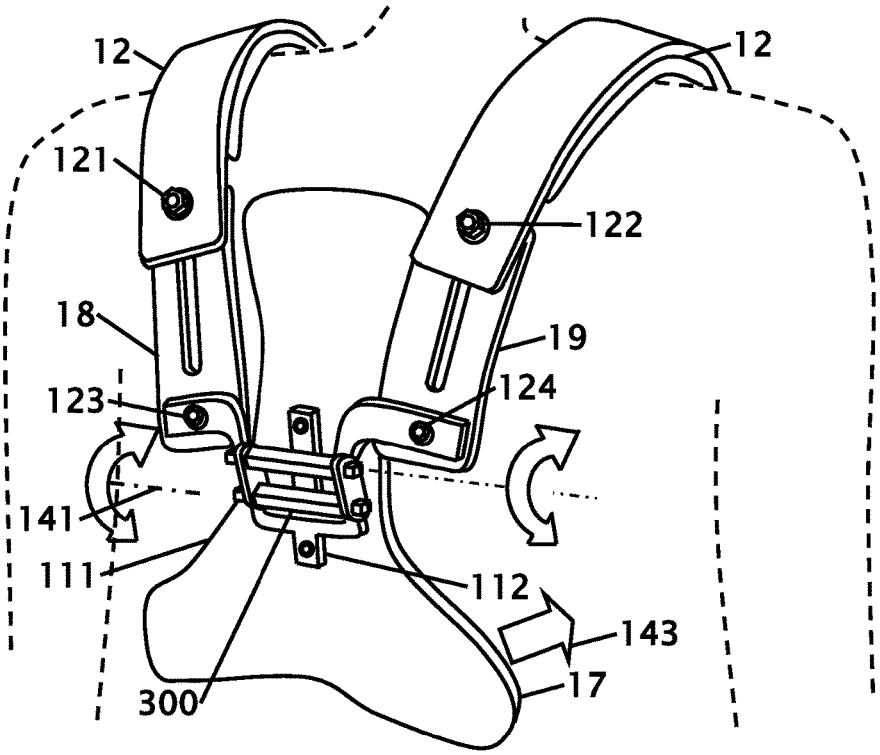
FIG. 15 shows a rear view of the conforming and articulating back member as a contemplated variation of the embodiment shown in FIG. 12.

FIG. 15 shows a rear view of the conforming and articulating back member as a contemplated variation of the embodiment shown in FIG. 12. In this contemplated embodiment the compound hinge 300 as shown and described in FIGS. 7 and 8 connects between the shoulder support extenders 18 and 19 and the back member 17.

Figure 16:
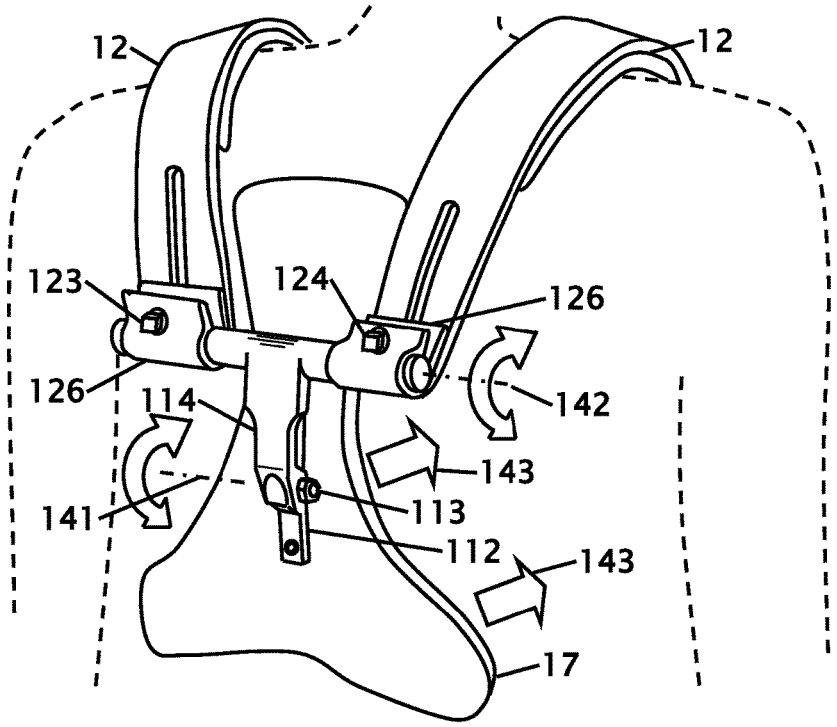
FIG. 16 shows a rear view of the conforming and articulating back member as a contemplated variation of the embodiment shown in FIG. 12.

FIG. 16 shows a rear view of the conforming and articulating back member as a contemplated variation of the embodiment shown in FIG. 12.

Figure 17:
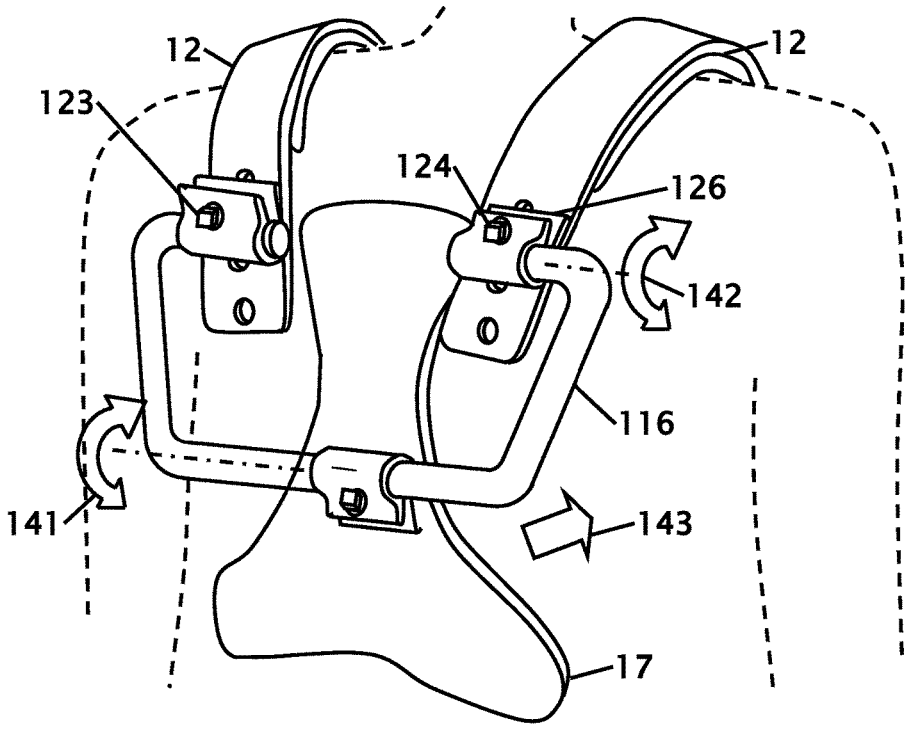
FIG. 17 shows a rear view of the conforming and articulating back member as a contemplated variation of the embodiment shown in FIG. 12.

FIG. 17 shows a rear view of the conforming and articulating back member as a contemplated variation of the embodiment shown in FIG. 12 where member 116 connects between the shoulder member(s) 12 and the back member 17.

Thus, specific embodiments and applications for a carrier with single and dual front mounted linear slides have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A shoulder supported harness assembly, comprising:

at least one shoulder support configured to rest on a user's shoulders and coupled to a connecting member, which is in turn coupled to a terminal back piece spaced distally from the at least one shoulder support so as to engage the user's back between the user's shoulder blades when the at least one shoulder support rests on the user's shoulders, wherein the connecting member couples the at least one shoulder support and the back piece such that the back piece is repositionable according to a double action hinge movement relative to the at least one shoulder support.

2. The shoulder supported harness assembly of claim 1, wherein the connecting member is further configured to translate along an end portion of the at least one shoulder support.

3. The shoulder supported harness assembly of claim 1, wherein the position of the connecting member according to the double action hinge movement is selectively fixable.

4. The shoulder supported harness assembly of claim 1, wherein the back piece is shaped so as to at least partially establish a contoured fit.

5. The shoulder supported harness assembly of claim 1, wherein the back member includes a cushion.

6. The shoulder supported harness assembly of claim 1, further comprising: a belly plate configured to support percussion instruments thereon, the belly plate at least indirectly coupled to the at least one shoulder support opposite the back piece.

7. The shoulder supported harness assembly of claim 1, wherein the double action hinge movement permits the back piece to simultaneously rotate and translate with respect to the shoulder support, along a vertical plane that is substantially perpendicular to the back piece.

8. The shoulder supported harness assembly of claim 1, wherein the connecting member includes at least one adjustable hinge joint configured to selectively fix a position of the back piece relative to the at least one shoulder support according to the double action hinge movement.

9. The shoulder supported harness assembly of claim 8, wherein the position includes at least one of: an angular position and a translational position.

10. The shoulder supported harness assembly of claim 1, wherein the connecting member comprises:

a horizontal portion pivotally coupled to the at least one shoulder support; and a vertical portion extending substantially perpendicular to the horizontal portion, the vertical portion pivotally coupled to the back piece.

11. The shoulder supported harness assembly of claim 10, wherein the position of the connecting member according to the double action hinge movement is selectively fixable.

12. The shoulder supported harness assembly of claim 10, wherein the double action hinge movement permits the back piece to simultaneously rotate and translate with respect to the shoulder support, along a vertical plane that is substantially perpendicular to the back piece.

13. The shoulder supported harness assembly of claim 10, wherein the connecting member includes at least one adjustable hinge joint configured to selectively fix a position of the back piece relative to the at least one shoulder support according to the double action hinge movement.

14. The shoulder supported harness assembly of claim 13, wherein the position includes at least one of: an angular position and a translational position.

15. The shoulder supported harness assembly of claim 1, wherein the connecting member comprises:

at least one proximal portion fixed to the at least one shoulder support;

at least one middle portion pivotally coupled to the proximal portion; and at least one distal portion pivotally coupled to the middle portion opposite the proximal portion, and fixed to the back piece.

16. The shoulder supported harness assembly of claim 15, wherein the position of the connecting member according to the double action hinge movement is selectively fixable.

17. The shoulder supported harness assembly of claim 15, wherein the double action hinge movement permits the back piece to simultaneously rotate and translate with respect to the shoulder support, along a vertical plane that is substantially perpendicular to the back piece.

18. The shoulder supported harness assembly of claim 15, wherein the connecting member includes at least one adjustable hinge joint configured to selectively fix a position of the back piece relative to the at least one shoulder support according to the double action hinge movement.

19. The shoulder supported harness assembly of claim 18, wherein the position includes at least one of: an angular position and a translational position.

* * * * *